US005591274A

United States Patent [19]

Takahashi

[11] Patent Number: 5,591,274

[45] Date of Patent: Jan. 7, 1997

[54] HEAT TREATMENT METHOD FOR METALS

[75] Inventor: Susumu Takahashi, Yokohama, Japan

[73] Assignee: Kanto Yakin Kogyo K.K., Kawagawa-kea, Japan

[21] Appl. No.: 510,907

[22] Filed: Aug. 3, 1995

[30] Foreign Application Priority Data

Aug. 18, 1994 [JP] Japan ..... 6-228583

[51] Int. Cl.[6] ..... C21D 9/00; C21D 1/76

[52] U.S. Cl. ..... 148/206; 148/235; 148/626

[58] Field of Search ..... 148/206, 235, 148/626, 625

[56] References Cited

U.S. PATENT DOCUMENTS 4,236,941 12/1980 Main, Jr. ..... 148/235

4,306,918 12/1981 Kaspersma et al. ..... 148/235

*Primary Examiner*—Deborah Yee

*Attorney, Agent, or Firm*—Shlesinger Fitzsimmons Shlesinger

[57] ABSTRACT

An exhaust gas of hydrocarbon is converted to an exothermic generated gas when it is burnt with air in a burner. The exothermic generated gas which has been dehydrated, is employed as a furnace atmosphere for decarburization or carburizing heat treatment, by the addition thereto of cracked methanol gas so that CO and $H_2$ contents of the atmosphere gas may get near 1:1.

6 Claims, 1 Drawing Sheet

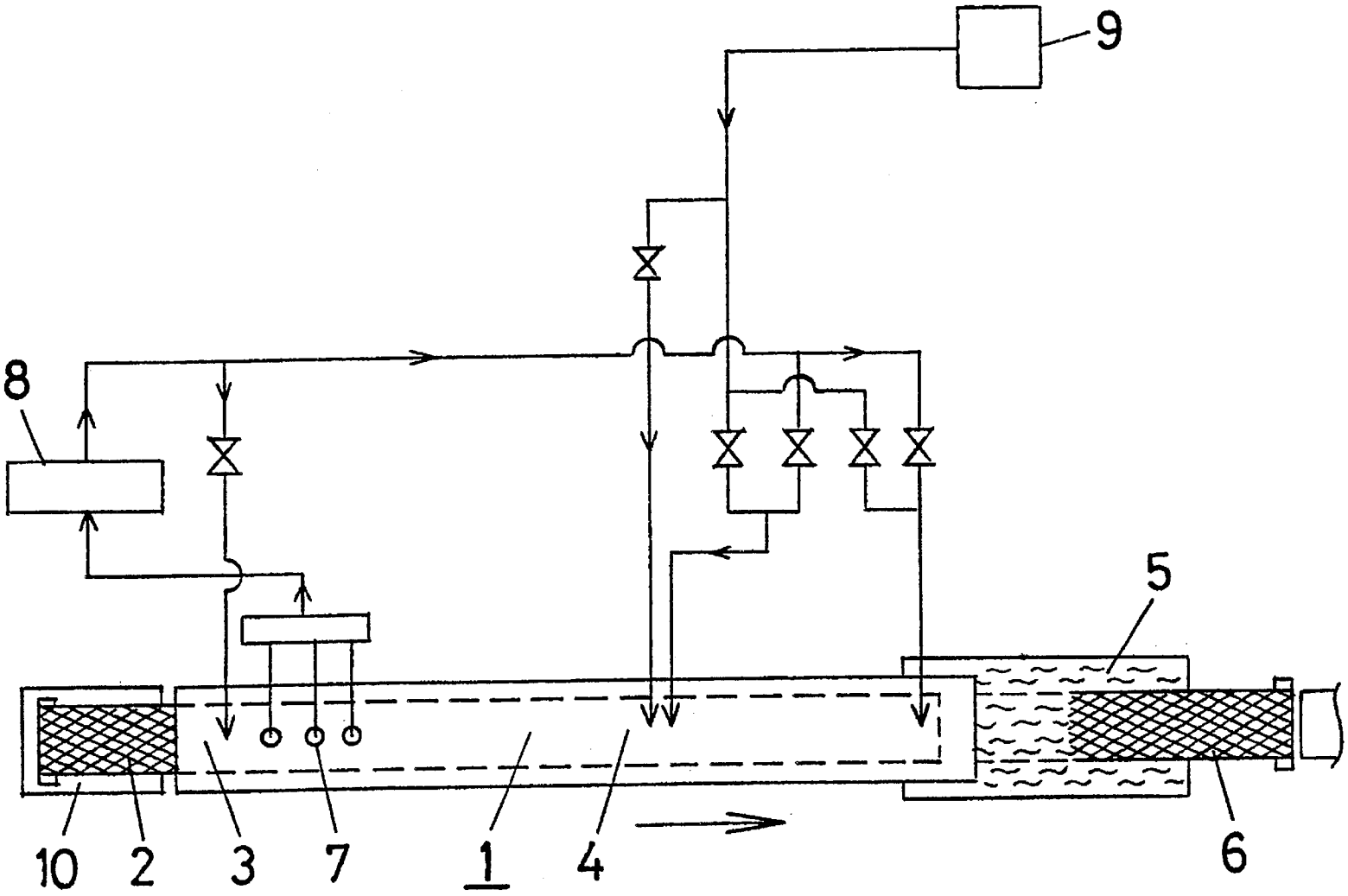
9
5
6
4
1
7
3
2
10
8

HEAT TREATMENT METHOD FOR METALS

BACKGROUND OF THE INVENTION

This invention relates to a heat treatment method for metals, more particularly a heat treatment method for carburizing steels in a continuous type atmosphere heat treatment furnace.

As described in Japanese Post-Examination Publication No. 58-27323 for example,it has been known that an exhaust gas from a combustion heating circuit in a furnace is generated to an exothermic gas which is, in turn, utilized as a furnace atmosphere gas. More particularly, this kind of atmosphere gas is made by freezing and dehydrating the exothermic generated gas. The gas thus converted is generally consisted of $N_2$(65–88%), CO(0–13%), $CO_2$(7–13%), $H_2$(0–17%) and $H_2O$(0–3%). While this gas is reductive against iron, steel and so on, it can not be utilized for carburizing steels.

BRIEF SUMMARY OF THE INVENTION

In this invention, to the aforementioned kind of exothermic generated gas, there is added a cracked alcoholic gas, preferably a cracked ethanol gas, whereby they can be utilized as a furnace atmosphere for carburizing steels. When a cracked methanol gas (CO: 33%, $H_2$: 66%) is added, as an alcoholic gas, to the exothermic generated gas and utilized as a furnace atmosphere, a bright heat treatment or non-decarbonization heat treatment of carbon steels can be attained. When the exothermic generated gas is further added by an ethanol vapor or hydrocarbon gas, a heat treatment for carburizing of steel can be attained.

BRIEF DESCRIPTION OF THE DRAWING

The accompanying drawing is an explanatory plan view of such atmosphere furnace for continuous heat treatment which can advantageously be employed in the practice of this invention method, and of a system for supplying to the furnace an atmosphere gas.

DETAILED DESCRIPTION OF EXAMPLE

With reference to the accompanying drawing, preferred examples of this inventions are described below.

In the drawing, numeral 1 represents a main body of a quenching furnace, 10 a platform for carrying into the furnace a metallic articles to be heat-treated in the furnace, and 5 a quenching oil bath. A conveyor belt 2 circulates through the furnace, atmosphere of which is heated to a desired temperature. A zone of the furnace indicated by 3 is an area which is located adjacent to an inlet opening of the furnace and kept at a comparatively low temperature, while a zone indicated by 4 is kept at a high temperature. The article to be treated in the furnace is moved by the conveyor belt 2 in the direction shown by an arrow indicated at the lower part of the drawing. Numeral 6 represents a conveyor belt installed in the quench oil tank 5 for taking out the article dropped into the tank. A hydrocarbon gas supplied into generator columns 7 via pipes (not shown) is burnt therein. This gas is taken out from the furnace 1, and frozen and dehydrated by a freezing type dehydrator 8 to produce an exothermic generated gas which is employable as a furnace atmosphere gas. The atmosphere gas thus produced is supplied into the furnace, as indicated by arrows and as regulated in a manner shown in the drawing. Numeral 9 represents an alcohol tank, from which alcohol is introduced into the furnace singularly or being mixed with the furnace atmosphere gas, after passing through a pump, flow meter, evaporator, cracking furnace, cooler, and so on (not shown).

It is preferable that the hydrocarbon furnace atmosphere gas be introduced into the comparatively low temperature area 3, without having been mixed with a cracked or evaporated alcohol gas. This is because that in the area 3, decarburization or cementation of metals can hardly occur, and that an excessive amount of carbon will bring a sooty atmosphere around the said area. It is preferable also that a large quantity of cracked or evaporated alcohol gas be introduced into the high temperature area 4 of the furnace, while a smaller amount of the alcohol gas will be introduced into an area adjacent to an outlet of the furnace.

EXAMPLE 1

In the generator columns 7, a gas was burnt at a ratio of 14.3% of methane and 85.7% of air. When this gas was frozen and dehydrated by the dehydrator 8, the gas containing 70.5% of $N_2$, 6.3% of $CO_2$, 8.52% of CO, 13.8% of $H_2$, and 0.86% of $H_2O$ was collected. This gas was added by 1.87 times of cracked methanol gas, and supplied into the furnace 1 heated to 880° C., as an atmosphere gas. In this furnace atmosphere, a steel containing 0.35% of carbon was successfully subjected to a bright heat treatment without decarburization.

EXAMPLE 2

The furnace temperature was raised to 930° C., and the exothermic generated gas which had been frozen and dehydrated, was added by 2.3% of methane to produce a furnace atmosphere. With this furnace atmosphere, low carbon steel was carburized. An excellent carburized layer was observed in the steel.

EXAMPLE 3

By passing through generator columns which were filled with cokes coated with barium carbonate and heated to 1,050° C., a gas mixture of one molecular weight of ethanol and one molecular weight of water was converted. The cracked methanol gas in Example 1. was replaced by the above converted gas. A bright heat treatment without decarburization was made similarly to Example 1.

EXAMPLE 4

The exothermic generated gas which had been frozen and dehydrated, was kept at 120° C., and added by 37.8% of ethyl alcohol which contained 41.18% of moisture and heated to 120° C. This mixed gas was introduced to the furnace kept at 930° C. A steel was carburized in the furnace, with excellent results.

In the method of this invention as described above, a hydrocarbon gas which has been exothermically generated, can readily be a furnace atmosphere which is adequate to a non-decarburization or carburizing heat treatment, simply by the addition of ethanol.

I claim:

1. A method of heat treating metals during passage thereof through a heat treating furnace, including obtaining a first atmosphere gas during passage of the metals through a first portion of the furnace by dehydrating an exothermic gas generated by the combustion of a hydrocarbonic gas in said first portion of the furnaces, and which first gas is primarily composed of $N_2$ and $CO_2$, selectively adding to said first gas externally of said furnace a cracked or evaporated alcoholic gas, and feeding the combined first and alcoholic gases into the furnace at a desired second portion thereof so that the metals are heat treated in said gases.

2. The method as claimed in claim 1, wherein the alcoholic gas added to the first gas is a cracked methyl alcohol.

3. The method as claimed in claim 1, wherein the alcoholic gas is an evaporated methyl alcohol.

4. The method as claimed in claim 1, wherein the alcoholic gas added to the first gas is made by cracking ethyl alcohol of one molecular weight with water of one molecular weight.

5. The method as claimed in claim 1, wherein a portion of the alcoholic gas is fed into the furnace independently from the first gas, and without having been added to the first gas.

6. The method as claimed in claim 1, wherein the first gas is fed into a relatively low temperature area of the furnace, while the alcoholic gas is introduced into a high temperature area of the furnace with or without having been added by the first gas.

* * * * *